US006955018B2

(12) United States Patent
Alderman

(10) Patent No.: US 6,955,018 B2
(45) Date of Patent: Oct. 18, 2005

(54) INSULATION SUPPORT FOR ROOF INSULATION APPLICATOR

(76) Inventor: Robert J. Alderman, 686 Highland Ter., Canyon Lake, TX (US) 78133

( * ) Notice: Subject to any disclaimer, the term of this patent is extended or adjusted under 35 U.S.C. 154(b) by 171 days.

(21) Appl. No.: 10/132,841

(22) Filed: Apr. 25, 2002

(65) Prior Publication Data

US 2003/0167731 A1 Sep. 11, 2003

Related U.S. Application Data

(63) Continuation-in-part of application No. 10/096,119, filed on Mar. 8, 2002, now Pat. No. 6,672,024.

(51) Int. Cl.[7] ..... E04B 1/74

(52) U.S. Cl. ..... 52/407.4; 52/404.5; 52/407.3; 52/742.12; 52/746.11; 52/749.12

(58) Field of Search ..... 52/404.3, 404.4, 52/404.5, 407.2, 407.5, 742.12, 746.11, 749.12

(56) References Cited

U.S. PATENT DOCUMENTS 3,992,847 A * 11/1976 Heath ..... 52/743
4,075,807 A 2/1978 Alderman
4,147,003 A * 4/1979 Alderman ..... 52/309.8
4,967,535 A 11/1990 Alderman
5,491,952 A * 2/1996 Alderman et al. ..... 52/749.12
5,495,698 A * 3/1996 Alderman et al. ..... 52/742.12
5,653,081 A 8/1997 Wenrick et al.
5,653,083 A * 8/1997 Alderman et al. ..... 52/749.12
5,664,740 A * 9/1997 Alderman et al. ..... 242/592
5,685,123 A 11/1997 Alderman et al.
5,921,057 A * 7/1999 Alderman et al. ..... 52/746.11
6,056,231 A * 5/2000 Neifer et al. ..... 242/557
6,195,958 B1 * 3/2001 Neifer et al. ..... 52/749.12

* cited by examiner

*Primary Examiner*—Jeanette Chapman
*Assistant Examiner*—Yvonne M. Horton
(74) *Attorney, Agent, or Firm*—Thomas, Kayden, Horstemeyer & Risley, LLP

(57) ABSTRACT

A plurality of sheet supports 50 or 70 of approximate rectangular configuration are placed on adjacent purlins 14 of a partially completed roof of an industrial building, about the second row of roof insulation support carriages 10. When the carriages are advanced along the lengths of the purlins to apply the sheet material 34 to the purlins, the sheet supports 50 or 70 move in unison with the carriages of the second row of carriages and the rear segment 54 supports the sheet material in the spaces 60 over which the carriage is mounted and the side segments 56 and 58 support the sheet material extending from the first row of carriages in the next adjacent spaces between the purlins. This avoids the sagging of the sheet material between the purlins at the time when the hard roof panels 37 are fastened to the purlins.

17 Claims, 6 Drawing Sheets

INSULATION SUPPORT FOR ROOF INSULATION APPLICATOR

CROSS REFERENCE TO RELATED APPLICATION

This is a continuation-in-part of U.S. patent application Ser. No. 10/096,119, filed Mar. 8, 2002 now U.S. Pat. No. 6,672,024.

FIELD OF THE INVENTION

This invention relates to the progressive application of flexible sheet material, such as blanket insulation, to the purlins of a roof during the progressive construction of a roof of an industrial building. More particularly, the invention involves a plurality of carriages for carrying reels of flexible sheet material in two rows of carriages along adjacent purlins of a roof and dispensing the sheet material onto the purlins in response to the movement of the carriages.

BACKGROUND OF THE INVENTION

Industrial buildings have roof structures that typically include inclined rafter beams that extend parallel to each other and are sloped from the eaves up to the ridge of the building structure. Horizontally oriented purlins are mounted on the rafters and extend parallel to each other in a direction normal to the rafters. The purlins are supported by the rafters and flexible sheet material, such as blanket insulation, is spread over the purlins. The lengths of the blankets can extend either normal to or parallel to the purlins. Hard roof panels are applied on the insulation and are connected through the insulation to the purlins.

In recent years, flexible insulation blankets have been applied to industrial buildings by orienting the lengths of the blankets parallel to the purlins and placing the opposed side edges of the blankets on the tops of the purlins so that each blanket spans the space between adjacent purlins. This procedure of applying the flexible sheet material to the purlins during the construction of a roof has the advantage of mounting the edges of the sheets on top of the purlins so that there are no seams between adjacent sheets that are directly exposed to the space below the purlins of the roof. This helps reduce the penetration of heat, moisture and other items carried by the environment within the building through the seams between the sheets to the roof panels.

In order to apply the blanket insulation to the purlins of the roof structure, a reel support carriage such as those disclosed in U.S. Pat. Nos. 3,559,914, 3,969,863, 4,075,807, 4,147,003, and 4,967,535 can be mounted on the purlins of the roof for supporting one or more of the reels of blanket insulation. The reel support carriage, sometimes known as a "roll stand," is guided by adjacent ones of the purlins and supports a supply of flexible sheet material, such as a reel of blanket insulation, above the space between the adjacent purlins.

Usually, a plurality of the reel support carriages are mounted on the purlins in two rows, with the first or forward row of carriages mounted over alternate spaces between the purlins and the second or rear row of carriages mounted over the other alternate spaces between the purlins. The workers stand on the hard roof panels that already have been applied to the purlins and push the carriages with push bars farther along the purlins to apply the blanket insulation as the blankets unroll themselves in response to the motion of the carriages. When the carriages have been pushed far enough away from the last applied roof panels, additional roof panels are applied to the purlins in the space between the last installed roof panels and the second row of carriages, and the procedure continues.

While the above noted process is suitable for applying blanket insulation to the purlins of a roof structure, other types of flexible sheet material can be applied in the same manner. For example, reflective sheet material, phase change material, and virtually any type of flexible sheet material that can be mounted on a carriage and progressively paid out from its supply and applied to the purlins can be installed in this manner.

One of the problems that is encountered in applying sheet material, such as fiberglass blanket insulation, to the purlins of industrial buildings is that the sheet material is suspended from its side edges that are applied to the tops of the purlins and the center portions of the sheets have no support and tend to sag between the purlins before the hard roof panels can be applied to the roof. Once the hard roof panels are applied by the insertion of fasteners through the hard roof panels down through the edges of the insulation sheets into the purlins, the sheet material becomes stabilized in its shape. If during the installation process the central portion of the sheet material is supported, the sagging of the central portion of the sheet material will be minimized after it has been installed. However, when the carriages that support the reel of sheet material are moved away from the previously installed hard roof panels, the insulation tends to sag downwardly between the purlins due to its lack of support before the roof panels are attached. This problem is affected by wind, the flexibility of the sheet material, the performance of the reel support carriages and the lack of experience and capability of the installers.

One of the solutions used in the industry to avoid the sagging of the sheet material between the purlins during the installation of a roof of an industrial building is to install metal bands in the roof structure before the sheet material is installed. The metal bands extend parallel to and between adjacent purlins at the desired height of the sheet material, thereby providing support for the sheet material when laid on the purlins and avoiding the sagging as described above. While the use of the support bands has reduced the problem of sagging insulation in the spaces between the purlins, the bands are expensive and are expensive to install at the building site. Moreover, the support bands have little function after the roof has been completely installed since the fasteners and hard roof panels adequately support the sheet material at the edges of the sheets and prevent excess sagging of the sheet material between the purlins. Further, the bands tend to compact the insulation more than when the insulation is suspended between the purlins without the use of bands. Compacting the insulation results in reduced insulating capacity of the blankets.

I developed an insulation carriage that includes a sheet support that extends from the carriage back beneath the previously paid out segment of sheet material toward the last applied hard roof panels, as disclosed in U.S. Pat. No. 4,967,535. The sheet supports of the carriages of the '535 patent support the sheet material extending from the second row of carriages that are close to the previously applied to the roof panels, but do not adequately support the sheet material when the carriages are moved away from the roof panels, particularly the first row of carriages that are always farther away from the roof panels. Also, the sheet supports of the '535 patent must be installed on all of the carriages and the carriages must carry the weight of the sheet supports, making the carriages heavier and more bulky than is desirable. And the sheet support of one carriage sometimes does not support its sheet at the same level as the others.

Thus, it can be seen that it would be desirable to provide a sheet support system for use in the construction of a roof of an industrial building that precisely holds the segment of the sheet material extending from a roof insulation support carriage back to the previously installed hard roof panels so that the sheet material is properly installed without the likelihood of undesirable sagging of the sheet material between the purlins once the roof structure has been completed. It is through the provision of such that the present invention is primarily directed.

SUMMARY OF THE INVENTION

The present invention involves a method and apparatus for applying flexible sheet material, such as blanket insulation, to the purlins of a roof structure of an industrial building, whereby the sheet material is applied parallel to the purlins with the edges of the sheets resting on the top surfaces of the purlins and fastened to the purlins by the hard roof panels and their fasteners.

A plurality of roof insulation support carriages are mounted on the purlins in two rows, a first or forward row of carriages with these carriages mounted over alternated spaces between the purlins, and a second or rear row of carriages mounted over the other alternate spaces between the purlins. A sheet support is connected to each rear carriage and is supported by the purlins on which the carriage is mounted, and moves in unison with the carriage as the carriage is advanced forwardly along the purlins.

The sheet support, in one embodiment of the invention, surrounds the carriage and has a forward segment that is pushed by the carriage when the carriage is advanced. The sheet support includes a rear segment that is displaced rearwardly from its carriage and spans the space between the adjacent purlins on which the carriage is mounted, and slides with the movement of the carriage on the purlins beneath the paid out segment of flexible sheet material extending from the carriage back to the previously installed roof panels. In addition, the sheet support has side segments that are positioned on opposite sides of the carriage and extend into the spaces of the next adjacent purlins to perform the same purpose in those spaces. Rear segments and side segments of the sheet support provide support for the flexible sheet material at a distance rearwardly from the carriage, that can be positioned immediately adjacent the expected position of the next to be installed hard roof panel.

In one embodiment of the invention, the rear segment and side segments of the sheet support form elongated slots therebetween that register with the purlins, so that the rear segment and side segments of the sheet support can extend all the way back from the carriage into the space where the next hard roof panel is to be installed, so that even as the panel is being fastened down to the purlins, the sheet support is in its supportive position beneath the flexible sheet material and beneath the panel that is being installed. In the meantime, the sheet support is resting on the purlins so that the exact desired height of the rear segment and side segments of the sheet support is attained, thereby providing optimum support for the flexible sheet material as it is being installed in the roof structure.

Typically, a plurality of the roof insulation support carriages would be mounted on the roof structure at one time, in two lines or rows, with the first or front row of carriages mounted on the purlins of every other space between the purlins, and a second or rear row of carriages mounted on the purlins at the other alternate spaces between the purlins. The sheet supports are required only on the rear row of carriages since the side segments of the sheet supports extend out into the alternate spaces over which the forward carriages are mounted. This has the advantage of utilizing only one-half the number of sheet supports as well as having the sheet supports of one size and configuration to serve the entire roof structure. Also, since the sheet supports are used with the second row of carriages, the sheet supports are used close to the installers that stand on the roof panels, thereby requiring less effort to handle the sheet supports during installing and using the sheet supports on the purlins.

Thus, it is an object of this invention to provide a sheet support for use with a roof insulation support carriage for accurately and expediently applying flexible sheet material, such as blanket insulation, to the purlins of a roof structure.

Another object of this invention is to provide an improved sheet support that is suitable for use with the second row of roof insulation support carriages that provides accurate support for flexible sheet material being applied to the roof structure by the carriages in both the first and second rows of carriages.

Another object of the invention is to provide a plurality of sheet support carriages in first and second rows of carriages on a roof structure and sheet supports associated with the second row of carriages that support the sheets extending from all of the carriages back to the previously installed roof panels.

Another object of the invention is to provide a combination of a carriage for applying sheet material to purlins of a roof of an industrial building and a sheet support for accurately supporting the sheet material paid out from the carriage at the desired level to avoid sagging of the sheet material between the purlins.

Another object of the invention is to provide a sheet support for an insulation carriage that supports the segment of sheet material extending from the carriage back to the previously installed roof panels, with the sheet supports resting on the purlins and functioning to support the sheets extending from both the first row and the second row of carriages.

Yet another object of the invention is to provide an improved method of installing sheet material, such as blanket insulation, to the purlins of a roof of an industrial building.

Other objects, features and advantages of this invention will become apparent upon reading the following specification when taken in conjunction with the accompanying drawings.

DETAILED DESCRIPTION

Figure 1:
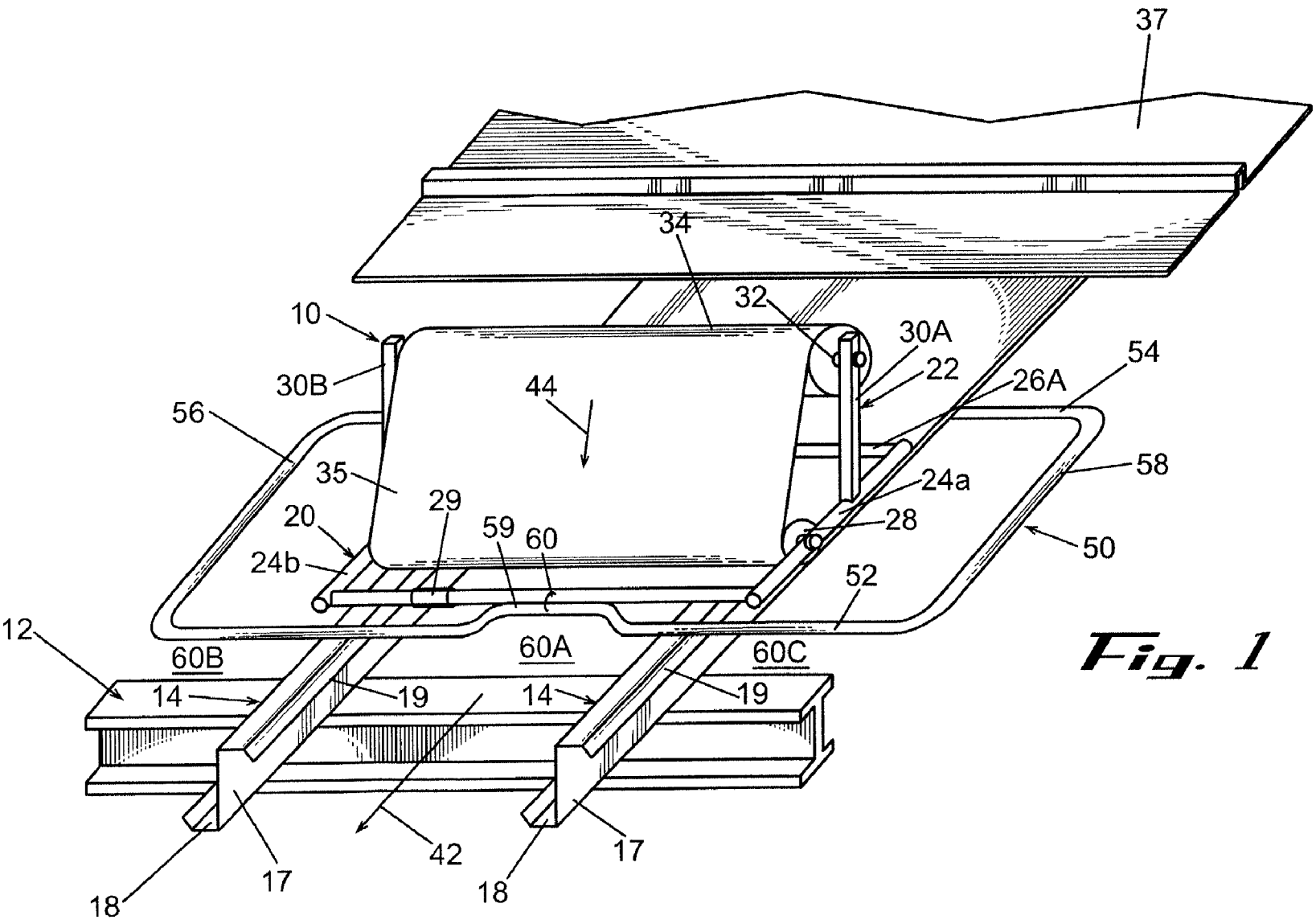
FIG. 1 is a perspective view of the roof insulation support carriage and its sheet support mounted on a pair of adjacent purlins of a roof structure, showing the sheet material paid out from its reel onto the purlins and with hard roof panels applied over the sheet material to the purlins.
Figure 2:
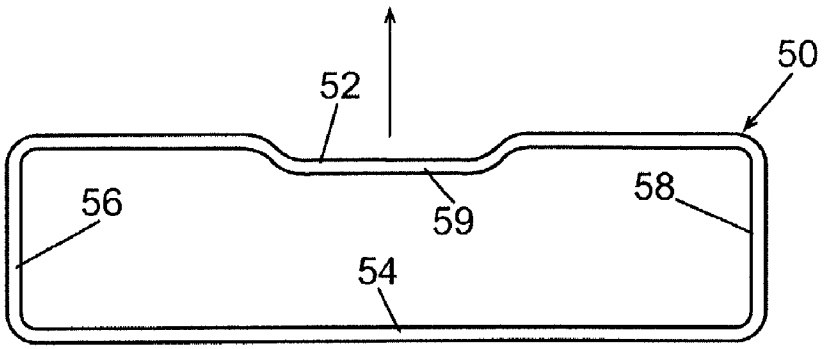
FIG. 2 is a plan view of the sheet support shown in FIG. 1.

Referring now in more detail to the drawings, in which like numerals indicate like parts throughout the several views, FIG. 1 is a perspective illustration of a roof insulation support carriage 10 mounted on a conventional, partially completed roof of an industrial building. The roof includes a plurality of parallel, inclined rafters 12 (only one shown) and a plurality of parallel, horizontally extending purlins, such as the pair of purlins 14 and 16. Each purlin includes a central web 17 and lower and upper oppositely facing flanges 18 and 19.

The roof insulation support carriage 10 includes a rectangular support frame 20 and a vertical reel support 22 mounted on and extending upwardly from the frame. The support frame 20 includes longitudinally extending side bars 24A and 24B and laterally extending cross bars 26A and 26B that form the rectangular shape of the support frame, and cross roller 28 that is rotatably supported by its axle to side bars 24A and 24B. The support frame 20, including the cross roller 28, is of sufficient size so as to span and rest upon adjacent ones of the purlins 14 and 16. A frame guide 29 is mounted to forward cross bar 26B of the support frame 20 for engagement with one of the purlins 14, by engaging the edge of the upper flange 19 of the purlin, for guiding the carriage along the lengths of the purlins 14 and 16. An additional frame guide can be used to engage the other purlin, if desired.

Sheet support 22 includes upright stanchions 30A and 30B mounted at their lower ends to the side bars 24A and 24B, respectively. Reel support axle 32 is mounted at its opposite ends to the upper ends of the stanchions, and a reel 34 of sheet material, such as blanket insulation, is mounted on the reel support axle 32. The free end portion 35 of the sheet material is paid out from the reel 34 and moved downwardly and about the cross roller 28, and then extended rearwardly on the upper flanges 19 of the adjacent purlins 14 and 16, as shown.

Figure 3:
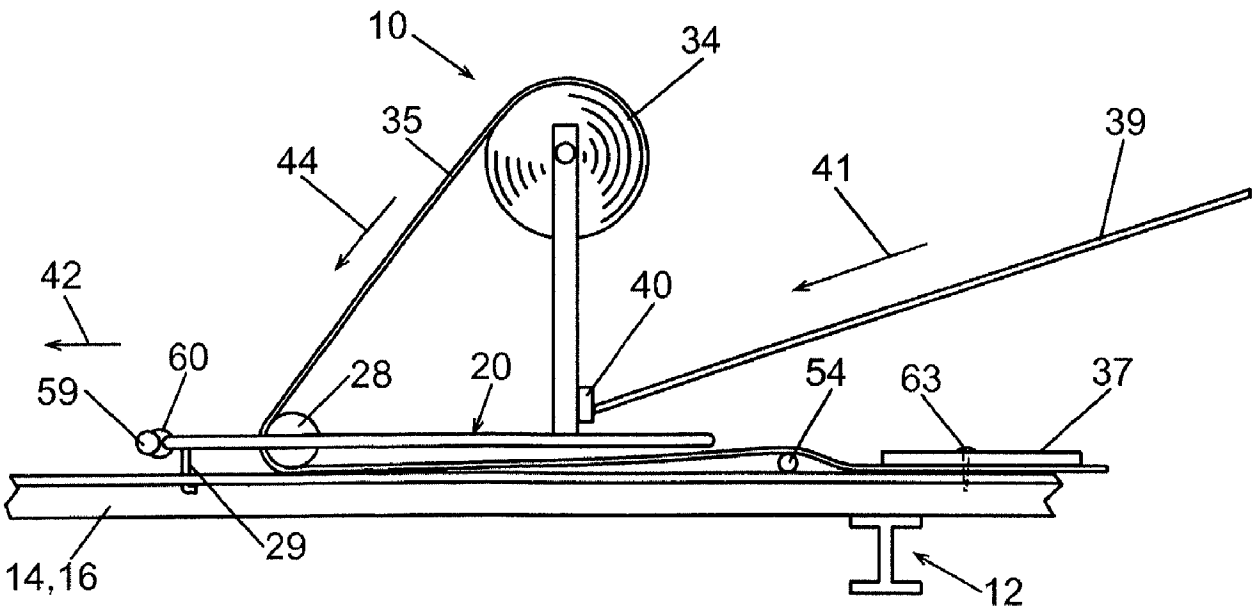
FIG. 3 is a side elevational view of the roof insulation support carriage and its sheet support of FIG. 1.

As shown in FIG. 3, when it is desired to advance the roof insulation support carriage 10, a worker standing on the hard roof panels 37 uses a push pole 39 to engage a socket 40 on the support frame 20 to push the carriage in the direction as indicated by arrow 42, forwardly away from the hard roof panel 37. As the carriage moves, additional insulation is paid out from the reel 34 as indicated by direction arrow 44, and is laid by the cross roller 28 onto the purlins 14, 16. In the meantime, the frame guide 29 extends from the cross bar 26B into engagement with the upper flange 19 of purlins 14, 16 so as to guide the roof insulation support carriage 10 along the lengths of the purlins.

A sheet support 50 is mounted about the support frame 20 of each support carriage 10 in the second row of carriages, and the sheet support 50 includes a forward segment 52, a rear segment 54, and opposed side segments 56 and 58, all of which generally form a rectangular shape. The distance between the forward segment 52 and rear segment 54 is sufficient to span the fore and aft dimension of the support carriage 10. Connection span 59 is formed in the forward segment 52 that is recessed toward the rear segment 54, and which is pivotally attached by a hinge 60 to the forward cross bar 26B of the support frame 20.

The sheet support 50 is formed of tubular metal, such as aluminum and is formed in a closed loop in a single plane. In the embodiment of FIGS. 1–5, the rear segment of the sheet support rests on the upper flanges 19 of the adjacent purlins 14, 16 on which the roof insulation support carriage rests, so that the sheet support is accurately supported in the desired position, at the level of the purlins. The side segments 56 and 58 extend beyond the space 60A between the purlins 14, 16 into the next adjacent spaces 60B and 60C, approximately one-half the distance toward the next adjacent purlin (now shown in FIG. 1).

Figure 4:
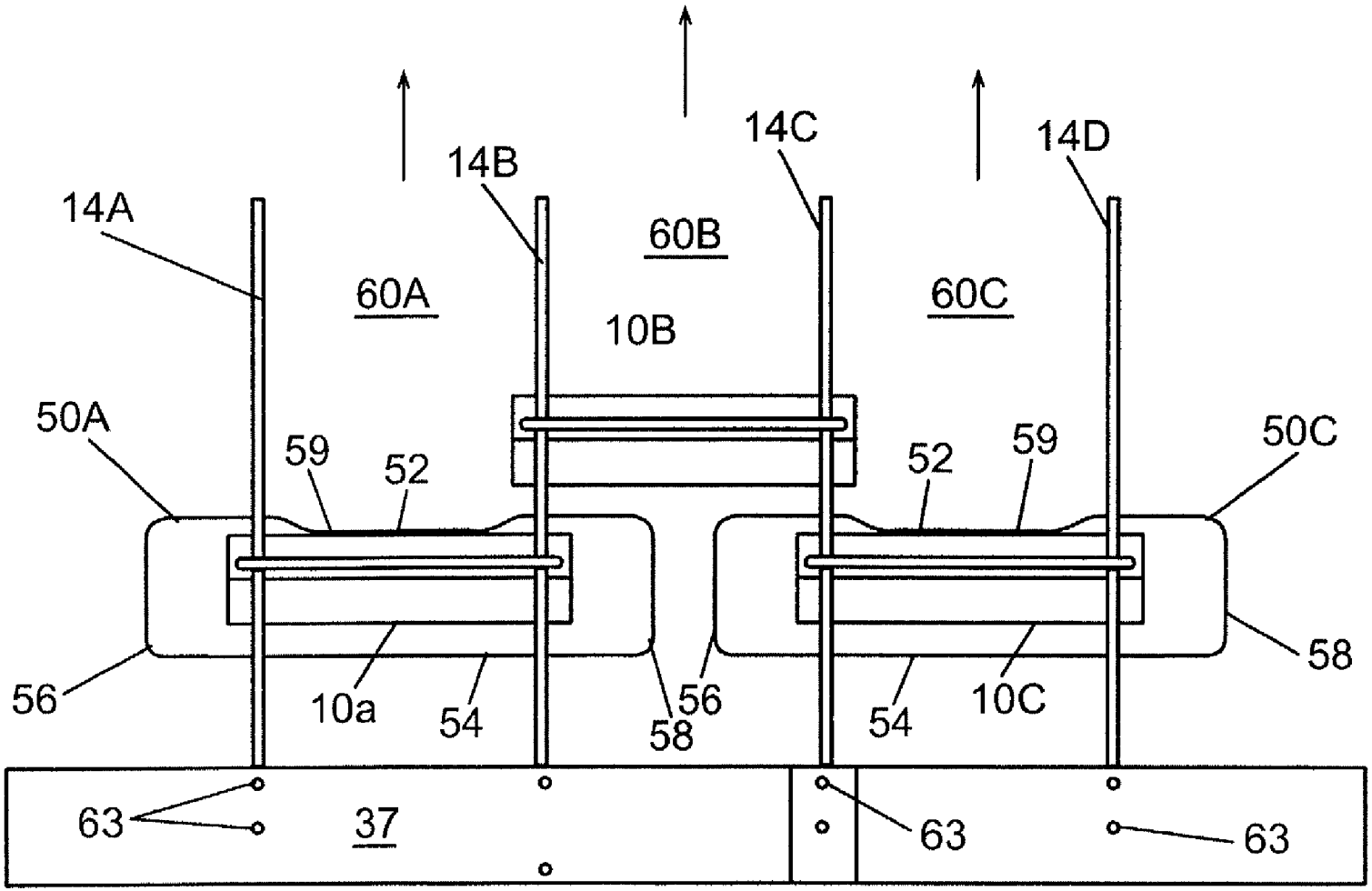
FIG. 4 is a plan view of a plurality of roof insulation support carriages, showing how the carriages are mounted in two rows on the purlins of a roof structure.

As shown in FIG. 4, when the roof structure of an industrial building is to be installed, a plurality of roof insulation support carriages will be mounted on the exposed purlins in two rows of carriages, with the first or forward row indicated by carriage 10B and the second or rearward row of carriages indicated by carriages 10A and 10C positioned over alternate spaces 60B, 60A and 60C, respectively. This arrangement of first and second rows of insulation support carriages is formed across as many purlins as practical for the job. The sheet supports, such as sheet supports 50A and 50C are positioned about the roof insulation support carriages of the second row, such as carriages 10A and 10C. A sheet support is not required for the forward or first row of carriages, such as carriage 10B.

It will be noted that the side segments 56 and 58 of the sheet supports extend beyond their purlins, into the next adjacent space, such as space 60B of the purlins, behind the forward roof insulation support carriage 10B. This presents support for all of the segments of sheet material that are paid out from the roof insulation support carriages mounted over all of the spaces between the purlins.

Figure 5:
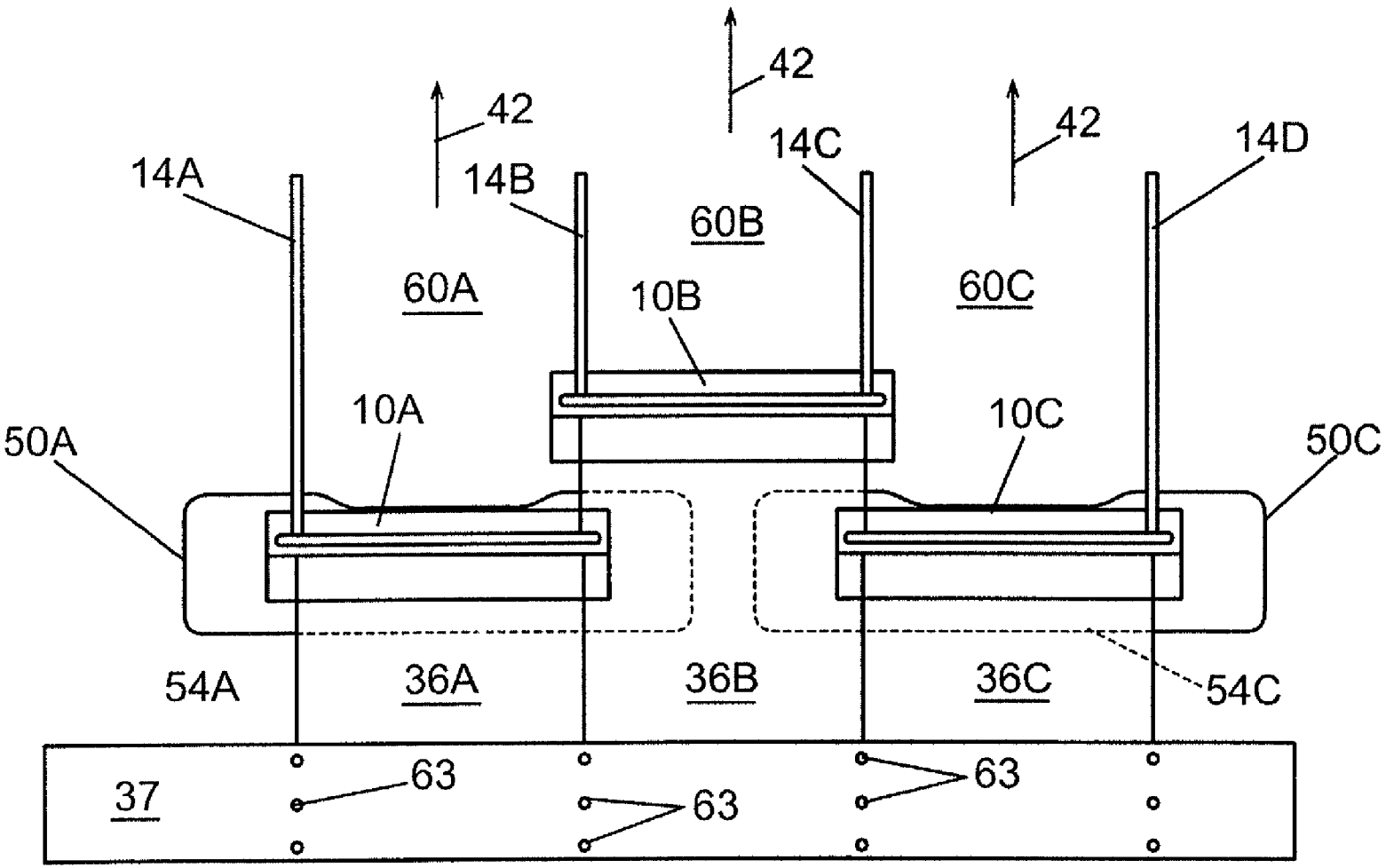
FIG. 5 is a plan view, similar to FIG. 2, but showing the sheet material paid out from the roof insulation support carriages onto the purlins.

As illustrated in FIG. 5, the segment 36A of the free end of the sheet material paid out from the reel of roof insulation support carriage 10A is supported by the rear segment 54A of the sheet support 50A in the space 60A between the adjacent purlins, so that there will be no sag in the sheet material at this position. In the meantime, hard roof panels 37 will have been applied to the roof by the use of fasteners 63 that are inserted down through the roof panels, through the sheet material, and into the upper flanges of the purlins. This anchors the edges of the sheet material in place, and does not require additional support, such as metal straps, to support the intermediate portion of the sheet material.

In the process of applying the roof to the purlins, the installers push the carriages 10A, 10B and 10C farther along the purlins a distance sufficient to install another roof panel 37 between the previously installed panel and the carriages. The sheet supports 50A and 50C as well as the upper flanges of the purlins hold the sheet material extending from both the first and second rows of carriages in the desired, non-sagging configuration while the next roof panels are installed with their fasteners 63.

Figure 6:
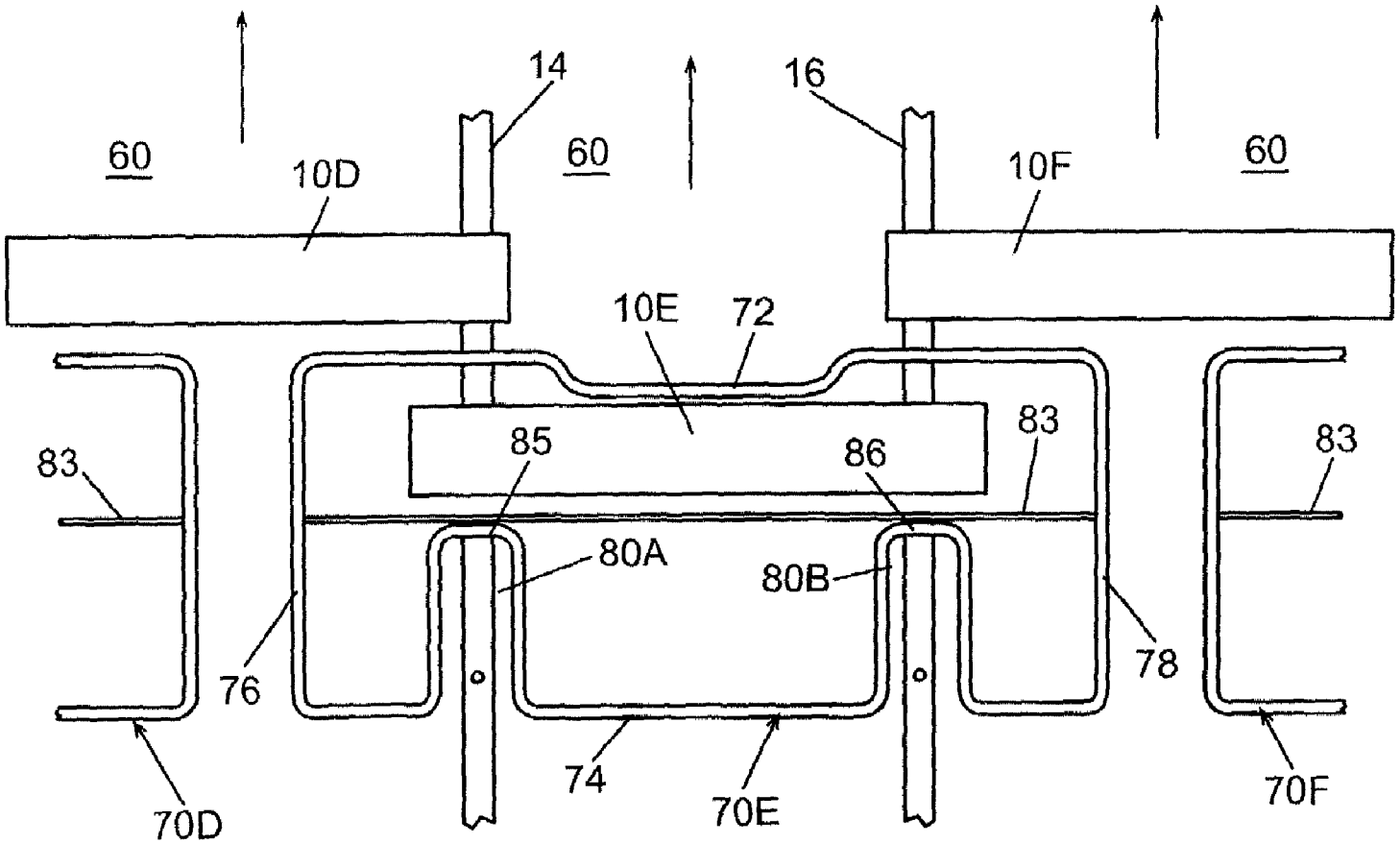
FIG. 6 is a plan view, similar to FIG. 4, but showing another embodiment of the sheet support mounted about the roof insulation support carriage.

As illustrated in FIG. 6, another embodiment of the sheet support is disclosed. Sheet support 70 is also formed of light weight metal of tubular cross section, formed in a closed loop. The sheet supports 70 are mounted about a roof insulation support carriages in the second row of carriages, such as carriage 10E. As with the carriages of FIGS. 4 and 5, the carriages 10*d*, 10E and 10F are arranged in adjacent first and second rows of carriages, and the sheet supports 70D, 70E and 70F are placed about only the carriages of the second row, behind the carriages of the first row. The sheet supports 70 also include a forward segment 72, rear segment 74, and opposed side segments 76 and 78. Slots 80A and 80B are formed between the side segments and the rear segment by the U-shaped bends 85 and 86, with the slots being spaced apart so as to register with the purlins on which the roof insulation support carriage and its sheet support are mounted.

Figure 8:
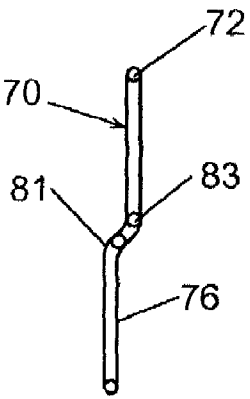
FIG. 8 is a cross sectional view of the sheet support, taken along lines 8—8 of FIG. 7.
Figure 7:
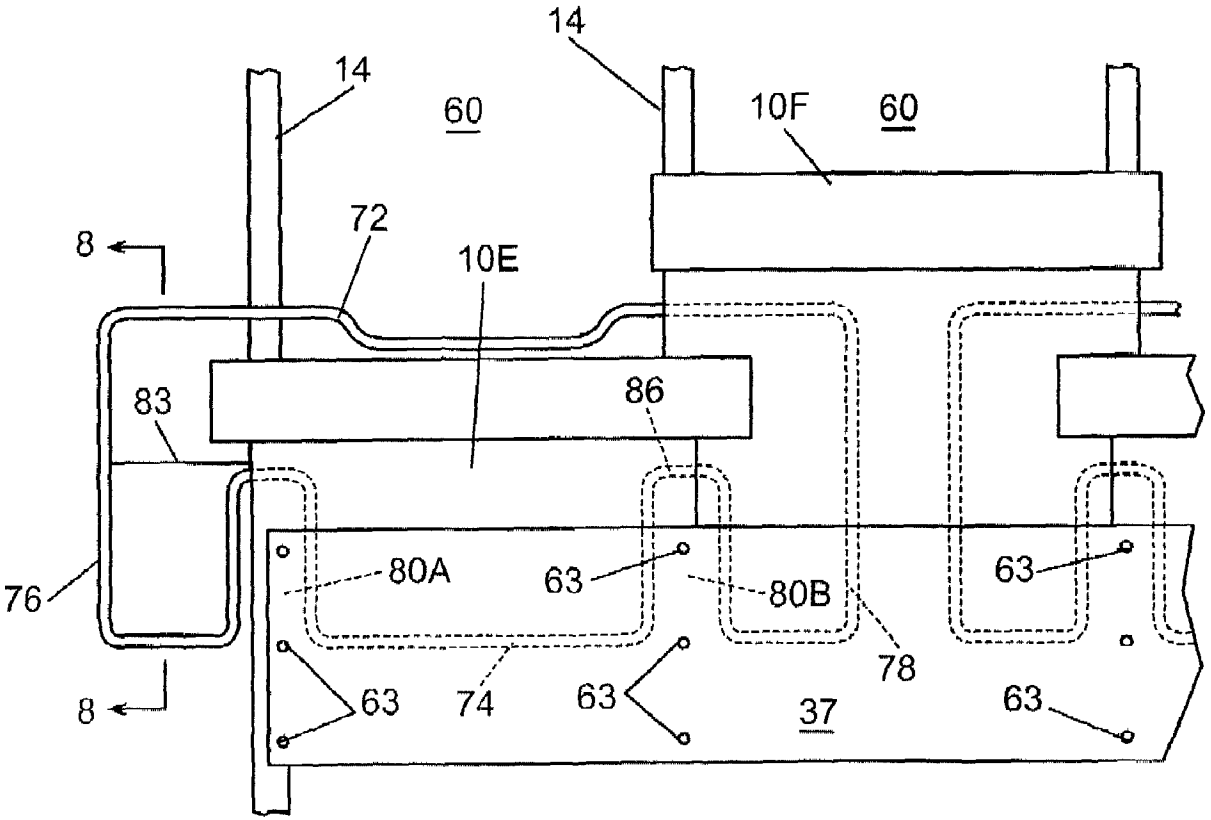
FIG. 7 is a plan view, similar to FIG. 6, but showing the sheet material paid out from the roof insulation support carriages over the sheet supports and onto the purlins, with a hard roof panel mounted on the sheet material and to the purlins.

As shown in FIG. 8, the sheet support 70 is formed with a dog leg 81 between the forward segment 72 and rear segment 74 and the rear portions of the side segments so that the rear segment and side segments will be positioned at a lower level than the forward segment. This recessed portions of the rear and side segments allows them to be positioned lower than the upper surface of the purlins the roof panels can be installed directly over the rear and side segments of the sheet support.

The operation of the sheet supports 70D, 70E and 70F is similar to that of the operation of the sheet supports 50A and 50C of FIGS. 4 and 5, except that the presence of the slots 70A and 70B of the sheet support 70 register with the purlins and the rear segment 74, and side segments 76 and 78 are positioned lower than the upper surfaces of the purlins and permit the next roof panels 37 to be applied to the purlins at positions closer to the support carriages 10E of the second row of carriages. Since the rear segment 74 and the side segments 76 and 78 of the sheet supports 70 extend far to the rear of the support carriage 10E, the sheet supports 70 function to provide support to the sheet material closely adjacent the previously installed roof panel, so that the next to be installed roof panel can be applied directly over the sheet supports.

An additional strengthening strut 83 is connected at its ends to the side segments 76 and 78 and intermediate its ends to the U-shaped bends 85 and 86 formed between the side segments 76 and 78 and the rear segment 74. This stabilizes the rear and side segments 74, 76 and 78 of the sheet supports 70.

The dog leg 81 of sheet support 70 allows the sheet material to be installed without excess compression of the sheet material against the rear segment 74 and side segments 76, 78 and allows rear and side segments of the sheet support to slide out from under the sheet material without excessive friction, to avoid scratching, tearing or stretching the sheet material.

As with the embodiment of FIGS. 1–5, the shape and position of the sheet supports 70D, 70E and 70F allow the sheet supports to be mounted about only the second row of carriages while supporting the segments of sheet material extending from both the forward and rear carriages. The side segments 76 and 78 protrude far enough into the adjacent spaces to support the sheet material extending from the carriages in the front row of carriages and into the adjacent spaces between purlins.

The roof insulation support carriage 10 can be of the type described and illustrated in my prior application Ser. No. 10/096,119, or in my prior patents U.S. Pat. Nos. 3,559,914, 4,147,003, 4,967,535, and others.

Although preferred embodiments of the invention has been disclosed in detail herein, it will be obvious to those skilled in the art that variations and modifications of the disclosed embodiments can be made without departing from the spirit and scope of the invention as set forth in the following claims.

I claim:

1. In combination, a roof insulation support carriage for use with similar roof insulation support carriages, each including a support frame for spanning and mounting on a pair of adjacent ones of a plurality of parallel purlins of a roof structure and a reel support disposed upwardly from said support frame for supporting a reel of flexible sheet material, so that as a plurality of the carriages are advanced forwardly along adjacent ones of the purlins flexible sheet material is paid out from reels of flexible sheet material supported by said reel supports and is laid behind the carriages onto the adjacent purlins, a sheet support pivotally connected to at least one of said carriages and configured to rest on the purlins of the roof structure on which the carriage is mounted and movable with said carriage along the purlins and having a rear segment extending rearwardly behind said carriage and movably supported by the purlins and spanning the space behind the carriage between the adjacent purlins on which said carriage is mounted and temporarily supporting and movable out from beneath the sheet material being paid out behind said carriage, said sheet support having side segments positioned on opposite sides of said rear segment in the spaces between the purlins on which the carriage rests and the next adjacent purlins and extending beyond opposed sides of said carriage beyond the purlins on which said carriage is mounted and movable along the purlins and slidably supporting flexible sheet material previously laid by other carriages on opposite sides of said carriage.

2. The combination of claim 1, wherein said sheet support is configured to move along the purlins of a roof structure behind said carriage.

3. The combination of claim 1, wherein said sheet support is configured to move in unison with said carriage and to pass beneath the sheet material as said carriage is advanced along the purlins of a roof structure.

4. The combination of claim 1, wherein said sheet support defines a pair of slots between said rear segment and said side segments for registering with the purlins of a roof structure.

5. The combination of claim 4, wherein said slots are wider than the purlins, whereby hard roof panels are applied to the purlins over said rear segment and said side segments and fastened through said slots to the purlins of a roof structure without fastening said sheet support to the purlins.

6. In combination, a roof insulation support carriage for use with similar roof insulation support carriages, each including a support frame for spanning and mounting on a pair of adjacent ones of a plurality of parallel purlins of a roof structure and a reel support disposed upwardly from said support frame for supporting a reel of flexible sheet material, so that as a plurality of the carriages are advanced forwardly along adjacent ones of the purlins flexible sheet material is paid out from reels of flexible sheet material supported by said reel support and is laid behind the carriages onto the adjacent purlins, a sheet support connected to at least one of said carriages and having a rear segment extending rearwardly behind said carriage for spanning the space behind the carriage between the adjacent purlins on which said carriage is mounted and for supporting the sheet material paid out behind said carriage, said sheet support having side segments extending to opposed sides of said carriage beyond the purlins on which said carriage is mounted and configured for supporting flexible sheet material laid by other carriages on opposite sides of said carriage, wherein said sheet support is pivotally connected to said carriage and is configured to rest on the purlins of a roof structure on which the carriage rests.

7. In combination, a roof insulation support carriage for use with similar roof insulation support carriages, each including a support frame for spanning and mounting on a pair of adjacent ones of a plurality of parallel purlins of a roof structure and a reel support disposed upwardly from said support frame for supporting a reel of flexible sheet material, so that as a plurality of the carriages are advanced forwardly along adjacent ones of the purlins flexible sheet material is paid out from reels of flexible sheet material supported by said reel supports and is laid behind the carriages onto the adjacent purlins, a sheet support connected to at least one of said carriages and having a rear segment extending rearwardly behind said carriage for spanning the space behind the carriage between the adjacent purlins on which said carriage is mounted and for supporting the sheet material paid out behind said carriage, said sheet support having side segments extending to opposed sides of said carriage beyond the purlins on which said carriage is mounted and configured for supporting flexible sheet material laid by other carriages on opposite sides of said carriage, wherein said sheet support comprises tubing in a substantially closed shape sized for surrounding said carriage.

8. In combination, a roof insulation support carriage for use with similar roof insulation support carriages, each including a support frame for spanning and mounting on a pair of adjacent ones of a plurality of parallel purlins of a roof structure and a reel support disposed upwardly from said support frame for supporting a reel of flexible sheet material, so that as a plurality of the carriages are advanced forwardly along adjacent ones of the purlins flexible sheet material is paid out from reels of flexible sheet material supported by said reel support and is laid behind the carriages onto the adjacent purlins, a sheet support connected to at least one of said carriages and having a rear segment extending rearwardly behind said carriage for spanning the space behind the carriage between the adjacent purlins on which said carriage is mounted and for supporting the sheet material paid out behind said carriage, said sheet support having side segments extending to opposed sides of said carriage beyond the purlins on which said carriage is mounted and configured for supporting flexible sheet material laid by other carriages on opposite sides of said carriage, said carriage being configured to ride over the flexible sheet material as the sheet material is paid out from said carriage onto the purlins of a roof structure and said sheet support is configured to pass beneath the sheet material paid out by said carriage.

9. A sheet support for supporting flexible sheet material between adjacent ones of a pair of purlins of a plurality of purlins of a roof structure, when the flexible sheet material extends rearwardly from a roof insulation support carriage that is mounted on the pair of purlins, comprising:

a forward segment for placement in front of a roof insulation support carriage, said forward segment of a width sufficient to span adjacent purlins and to be pushed by the carriage along the lengths of the purlins, a rear segment for placement behind a roof insulation support carriage for spanning the space between the purlins, and side segments positioned on opposite sides of said rear segment for placement in the space between the purlins on which the carriage rests and the next adjacent purlins, said side segments and said rear segment attached to said forward segment so that when a roof insulation support carriage is advances along the purlins, said forward segment is pushed by the roof insulation support carriage and pulls said rear and side segments.

10. The sheet support of claim 9, wherein said sheet support is formed of a closed loop tube structure.

11. The sheet support of claim 9, wherein slots are formed between said rear segment and said side segments for registering with adjacent ones of the purlins of a roof structure.

12. A sheet support for placement on a pair of adjacent purlins of a plurality of purlins of a partially completed roof structure next to a carriage mounted on the pair of adjacent purlins that pays out flexible sheet material onto the pair of adjacent purlins, comprising:

a rear segment for placement behind the carriage, said rear segment supported by the pair of purlins and spanning the space between the pair of adjacent purlins on which the carriage is mounted, side segments positioned on opposite sides of said rear segment for extending beyond the pair of adjacent purlins on which the carriage is supported for supporting sheet material between the next adjacent purlins, a front segment for placement in front of a carriage, whereby said front segment, said rear segment and said side segments form a closed loop for surrounding the carriage, and connector means for connecting said sheet support to the carriage so that the sheet support moves in unison with the carriage along the pair of purlins.

13. In combination, a roof insulation support carriage having a support frame for spanning and mounting on a pair of adjacent ones of a plurality of parallel purlins of a roof structure and a sheet material support mounted on said support frame for supporting flexible sheet material, so that as a plurality of similar ones of the carriages are advanced forwardly along adjacent ones of the purlins flexible sheet material is paid out from said carriages and is laid behind said carriages onto the adjacent purlins, and hard roof panels are applied over the flexible sheet material to the purlins, a sheet support movable with the carriage and configured for resting on and moving along the purlins, said sheet support having a rear segment extending rearwardly behind said carriage toward the position of the hard roof panels and resting on and movable along the adjacent purlins on which the carriage is supported for spanning the space behind the carriage between the adjacent purlins on which said carriage is mounted and for slidably supporting the sheet material paid out onto the purlins behind said carriage, said sheet support being of a width sufficient to extend to opposite sides of said carriage a distance beyond said carriage sufficient to reach beyond the adjacent purlins on which said carriage is mounted and configured for supporting flexible sheet material at positions beyond the adjacent purlins laid by other carriages on opposite sides of said carriage.

14. A process of applying a plurality of flexible sheet material to a plurality of parallel purlins of a roof comprising:

arranging sheet support carriages in first and second rows of carriages with the first row of carriages positioned over alternate ones of the spaces between the purlins, and the second row of carriages positioned over the other alternate spaces between the purlins, and with the first row of carriages displaced forwardly of the second row of carriages along the lengths of the purlins, supporting flexible sheet material on each carriage, advancing the plurality of sheet support carriages in first and second rows of carriages along the purlins, in response to the carriages being advanced along the lengths of the purlins, paying out the sheet material from the carriages onto the purlins, moving sheet supports with each carriage in the second row of carriages, supporting segments of sheet material extending from the carriages in both the first and second rows of carriages with the sheet supports of the second row of carriages.

15. A process of applying a plurality of flexible sheet material to a plurality of parallel purlins of a roof comprising:

arranging sheet support carriages in first and second rows of carriages with the first row of carriages positioned over alternate ones of the spaces between the purlins, and the second row of carriages positioned over the other alternate spaces between the purlins, and with the first row of carriages displaced forwardly of the second row of carriages along the lengths of the purlins, supporting flexible sheet material on each carriage, advancing the plurality of sheet support carriages in first and second rows of carriages along the purlins, in response to the carriages being advanced along the lengths of the purlins, paying out the sheet material from the carriages onto the purlins, moving sheet supports with each carriage in the second row of carriages, supporting segments of sheet material extending from the carriages in both the first and second rows of carriages with the sheet supports, wherein the step of moving sheet supports with each carriage comprises sliding a sheet support along the purlins on which the carriage is mounted.

16. The process of claim 15, wherein the step of supporting segments of sheet material extending from carriages in both the first and second rows of carriages comprises placing a sheet support on the purlins on which the carriage is mounted and extending the sheet support into the spaces adjacent the purlins on which the carriage is mounted.

17. A process of applying flexible sheet material to parallel purlins of a partially completed roof structure with the purlins defining spaces therebetween comprising:

mounting a sheet support carriage on a pair of adjacent purlins in a plurality of parallel purlins of the roof structure with the sheet support carriage spanning the space between the pair of adjacent purlins, advancing the carriage along the lengths of the pair of adjacent purlins, paying out sheet material from the carriage onto the tops of the pair of adjacent purlins in response to the advancement of the carriage along the lengths of the pair of adjacent purlins, moving a sheet support on the pair of adjacent purlins at a position behind the carriage in response to the advancement of the carriage with the sheet support extending in the space between the pair of adjacent purlins and extending beyond the pair of adjacent purlins and in the spaces besides the pair of adjacent purlins, as the sheet support slides along the pair of adjacent purlins, moving the sheet support beneath the sheet material paid out from the carriage and supporting the sheet material with the sheet support, and moving the sheet support beneath the sheet material spanning the spaces adjacent the pair of adjacent purlins, applying roof panels over the sheet material and to the pair of adjacent purlins while the sheet material is supported by the sheet support.

* * * * *